United States Patent [19]

Masaki

[11] Patent Number: 4,855,649

[45] Date of Patent: Aug. 8, 1989

[54] SINGLE-WIRED SWITCHING CIRCUIT DIRECTED TO LIMIT SURGE INTO LAMP

[75] Inventor: Kazumi Masaki, Osaka, Japan

[73] Assignee: Ken Hayashibara, Okayama, Japan

[21] Appl. No.: 149,184

[22] Filed: Jan. 27, 1988

[30] Foreign Application Priority Data

Feb. 9, 1987 [JP] Japan ..... 62-26429
Feb. 9, 1987 [JP] Japan ..... 62-26430

[51] Int. Cl.[4] ..... H05B 37/02

[52] U.S. Cl. ..... 315/310; 315/DIG. 5; 315/311; 361/58; 323/908; 323/902

[58] Field of Search ..... 361/58, 28; 323/908, 323/902, 239, 242; 315/310, DIG. 5, 158, 151, 309, 311, DIG. 7, DIG. 4; 307/135

[56] References Cited

U.S. PATENT DOCUMENTS 4,463,284 7/1984 Tamura et al. ..... 315/309
4,555,741 11/1985 Masaki ..... 361/58
4,572,992 2/1986 Masaki ..... 315/310
4,644,229 2/1987 Masaki ..... 315/310
4,701,675 10/1987 Masaki ..... 315/310
4,716,511 12/1987 Masaki ..... 315/310

FOREIGN PATENT DOCUMENTS 3438003 4/1986 Fed. Rep. of Germany .

*Primary Examiner*—Leo H. Boudreau
*Assistant Examiner*—Michael Razavi
*Attorney, Agent, or Firm*—Browdy and Neimark

[57] ABSTRACT

Disclosed is a novel switching circuit directed to use for limiting surge into lamp, comprising a diode circuit wherein two sets of diodes are connected in reverse-parallel; a resistive element connected in series with a lamp to limit the switch-on surge thereinto; a bidirectionally conductive element having a main current path connected in seried with an ac source through said resistive element, diode circuit and lamp; and a timing circuit having a time constant, said timing circuit triggering said bidirectionally conductive element with the voltage across said diode circuit to short-circuit said resistive element after a lapse of said time constant from switch-on.

3 Claims, 4 Drawing Sheets

SINGLE-WIRED SWITCHING CIRCUIT DIRECTED TO LIMIT SURGE INTO LAMP

BACKGROUND OF THE INVENTION

1. Field of the invention

The present invention relates to a switching circuit to limit surge into lamp, specifically, a single-wired switching circuit directed to limit surge into lamp.

2. Description of the prior art

One of the major causes of lamp outage is the switchon surge that may be 10-fold larger or more than the current in the stationary state. For example, the current across 100 watt lamp exhibiting a filament resistance of 100 ohms in the stationary state is one ampere when energized with 100 volts. Since the filament resistance at ambient temperature is about 10 ohms, a surge of 14 amperes (=140 volts/10 ohms) arises and its magnitude is 14-fold larger than that in the stationary state when the filament is energized with conventional ac 100 volts at its peak, i.e. 140 volts.

U.S. Pats. Nos. 4,555,741 and 4,572,992 disclose that the voltage drop across diodes is used to actuate switching devices, such as magnetic relay and thyristor, to regulate the current across loads including lamp and electric motor.

SUMMARY OF THE INVENTION

In view of the foregoing, the present inventor investigated various means that limit switch-on surge into lamp.

As the result, the present inventor found that such switch-on surge can be effectively limited with a switching circuit comprising a diode circuit wherein two sets of diodes are connected in reverse-parallel; a resistive element connected in series with a lamp to limit the switch-on surge thereinto; a bidirectionally conductive element having a main current path connected in series with an ac source through said resistive element, diode circuit and lamp; and a timing circuit having a time constant, said timing circuit triggering said bidirectionally conductive element with the voltage across said diode circuit to short-circuit said resistive element after a lapse of said time constant from switch-on.

DESCRIPTION OF THE PREFERRED EMBODIMENTS

The present invention will hereinafter be explained with reference to the accompanying drawings, in which.

Throughout the drawings, symbol R designates resistor; C, capacitor; D, diode; L, lamp; BCR, bidirectionally conductive element; S, switch; SCR, thyristor; AC, ac power source; Th, thermistor; and CDS, photosensitive resistor.

Figure 1:
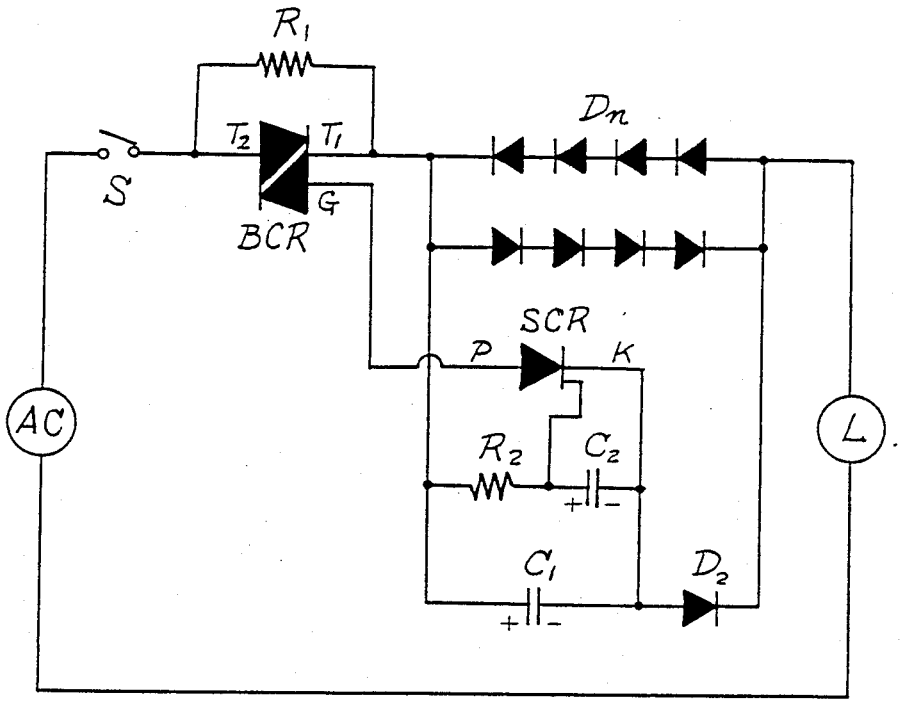
FIG. 1 is a basic circuit of the present invention.

In the circuit as shown in FIG. 1, the outage of lamp L is prevented by connecting series resistor $R_1$ in parallel to bidirectionally conductive element BCR so that switch-on current flows through series resistor $R_1$ from power source AC into lamp L.

Now supposing that series resistor $R_1$ is 100 ohms and the filament resistance of lamp L at ambient temperature is 10ohms, the circuit resistance becomes 110 ohms (=100 ohms+10 ohms) to reduce the peak current to 0.9 amperes when energized with ac 100 volts. Even when the peak voltage, i.e. 140 volts, is applied thereto, a current of only 1,27 amperes (=140 volts/110 ohms) flows across lamp L.

The filament resistance of lamp L is about 10 ohms immediately upon switch-on, but increases as the filament temperature elevates on heating.

Figure 3:
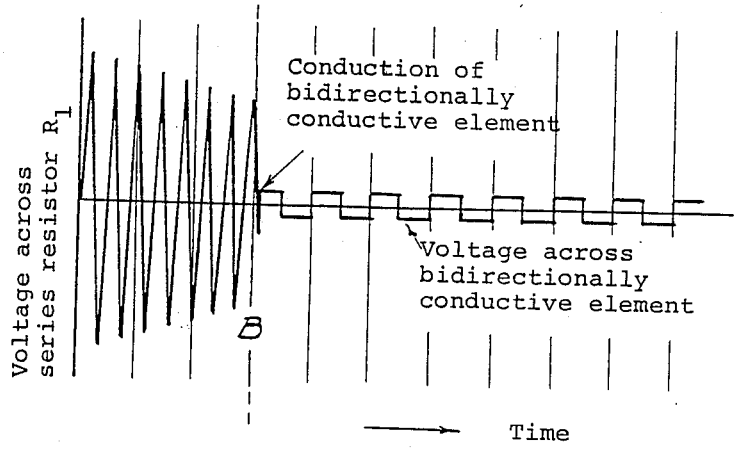
FIG. 3 is the waveform observed across bidirectionally conductive element BCR.

FIG. 3 indicates that the voltage across series resistor $R_1$ decreases as a function of time.

Since in diode circuit Dn connected in series to the lamp circuit two sets of diodes are arranged in reverse-parallel, a voltage drop of about 0.7 volts can be obtained per diode. The voltage drop is independent on the magnitude of the current across the diode.

When four diodes are cascaded in one direction in the manner as shown in FIG. 1, a voltage drop of 2.8 volts can be obtained. The voltage drop is rectified by diode $D_2$ to charge capacitor $C_1$. When the time to charge capacitor $C_2$ through resistor $R_2$ is set to 0.1–0.2 seconds by controlling the time constant as determined by capacitor $C_2$ and resistor $R_2$, thyristor SCR is triggered about 0.1–0.2 seconds after switch-on. Thus, a circuit is formed from the plus terminal of capacitor $C_1$, terminal $T_1$ and gate G of bidirectionally conductive element BCR, and anode P and gate K of thyristor SCR so that a negative voltage is applied to the gate of bidirectionally conductive element BCR to bring it into conduction.

Figure 2:
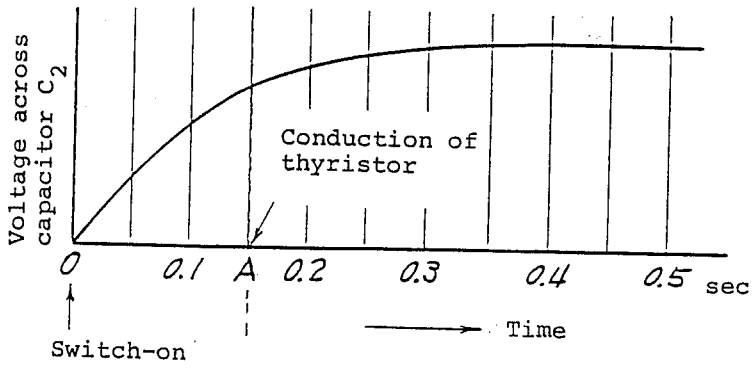
FIG. 2 is the charging curve of capacitor.

The waveform in FIG. 2 shows this operation, wherein thyristor SCR is triggered 0.15 seconds after switch-on to trigger bidirectionally conductive element BCR in FIG. 1. This reduces the voltage drop across resistor $R_1$ to a level of only that across bidirectionally conductive element BCR.

Figure 4:
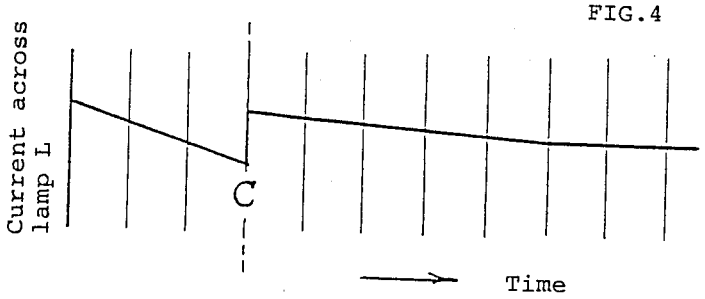
FIG. 4 is the current curve in lamp.

As shown in FIG. 4, immediately after switch-on a current slightly larger than that in the stationary state flows across lamp L, while after a lapse of 0.15 seconds the current decreases as the filament of lamp L is heated. When this occurs, the conduction of bidirectionally conductive element BCR short-circuits series resistor $R_1$, and the current temporary increases as shown with symbol "C" but, after a lapse of 0.4 seconds, decreases to the stationary level.

Figure 5:
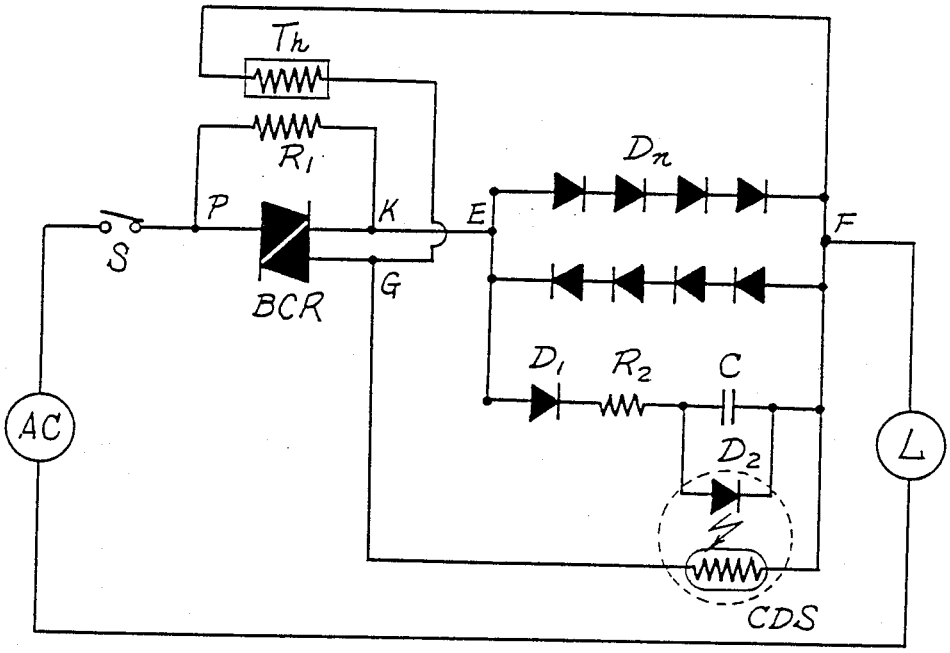
FIG. 5 is another basic circuit of the present invention.

FIG. 5 is another basic circuit of the invention, wherein a circuit from power source AC through terminal P and resistor $R_1$ to lamp L is formed to actuate lamp L when power switch S is closed.

Now supposing that resistor $R_1$ is, for example, 100 ohms and lamp L is a 100 watt lamp exhibiting a filament resistance of 10 ohms at ambient temperature, a current of about 0.9 amperes flows into lamp L to heat up its filament to several hundred ° C.

The current generates across terminals E and F of diode circuit Dn a voltage drop of about 2.8 volts that is independent of the magnitude of the current across the diodes.

In diode circuit Dn wherein two sets of diodes are arranged in reverse-parallel, the voltage drop per diode is about 0.7 volts.

The voltage drop across terminals E and F is rectified by rectifier diode $D_1$ to charge capacitor C through resistor $R_2$. The time constant of resistor $R_2$ and capacitor C in the charging circuit provides a heat-up time of 0.1–0.3 seconds for lamp L. After a lapse of a prescribed time from switch-on of power switch S, capacitor C discharges into light-emitting diode $D_2$, and the resultant emission reduces the resistance of photosensitive resistor CDS from several hundred ohms to several ten ohms.

When the resistance of photosensitive resistor CDS decreases to several ten ohms, the voltage at terminal F in diode circuit Dn is applied to gate G of bidirectionally conductive element BCR through photosensitive resistor CDS to trigger the bidirectionally conductive element and to shortcircuit series resistor $R_1$.

Figure 6:
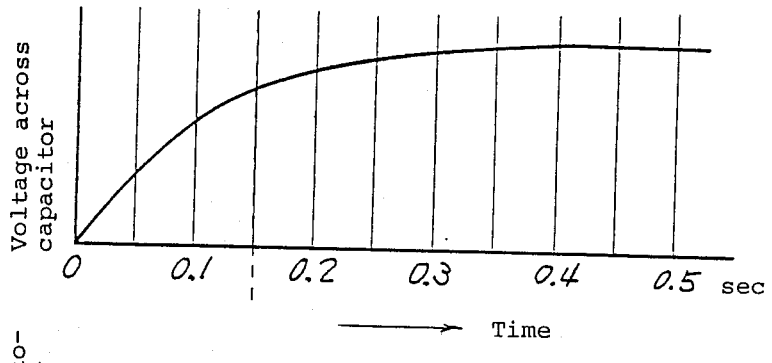
FIG. 6 is the charging curve of a capacitor.

FIG. 6 shows the charging curve of capacitor C. About 0.15 seconds after switch-on, the voltage across capacitor C reaches a level sufficient to actuate light-emitting diode $D_2$.

Figure 7:
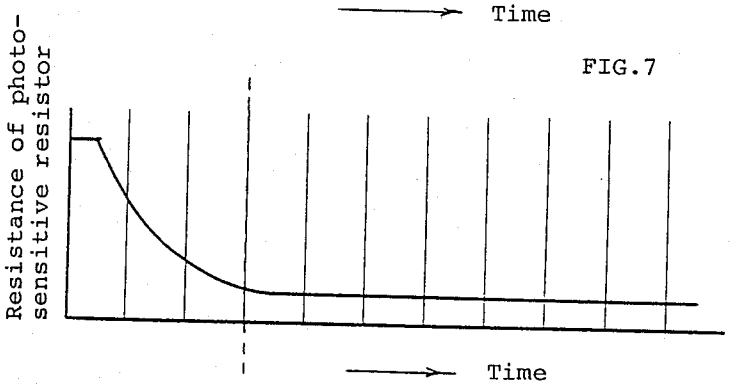
FIG. 7 is the resistance curve of photosensitive resistor CDS.
Figure 8:
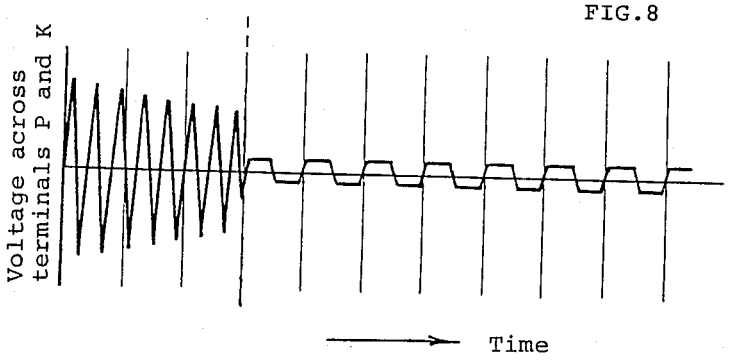
FIG. 8 is the voltage across bidirectionally conductive element BCR.

When light-emitting diode $D_2$ emits light, the resistance of photosensitive resistor CDS decreases to about 1/100 as shown in FIG. 7, as well as providing at terminal F a voltage that is large enough to trigger bidirectionally conductive element BCR. When bidirectionally conductive element BCR is triggered, the voltage waveform across terminals P and K changes as shown in FIG. 8 wherein, since resistor $R_1$ is 100 ohms and the resistance of lamp L at time "0" is 10 ohms, a current of 0.9 amperes (=100 volts/100 ohms+10 ohms) heats lamp L to elevate its filament temperature. The voltage across resistor $R_1$ decreases as shown in FIG. 8 as the filament temperature elevates.

After a lapse of 0.15 seconds from switch-on, bidirectionally conductive element BCR conducts and shortcircuits resistor $R_1$. Thus, the rated voltage is applied to lamp L, and the voltage across terminals P and K is reduced to that across bidirectionally conductive element BCR as shown in the latter half of FIG. 8.

If the charging circuit and/or light-emitting diode goes out of order or works abnormally, series resistor $R_1$ may be burned by overheating. Such burning can be avoided by attaching thermistor Th to series resistor $R_1$ in such manner that, when series resistor $R_1$ is overheated, the resistance of thermistor Th decreases to several ten ohms to supply in place of photosensitive resistor CDS a voltage across diode circuit Dn to the gate of bidirectionally conductive element BCR and also to bring it into conduction.

As described above, the use of the present switching circuit limits the switch-on surge into the lamp to prolong its life.

Furthermore, since the switching circuit of the invention is single-wired, it can be easily assembled in conventional power circuit or switch.

In addition, when a thyristor or a photocoupler is used in the invention for its timing circuit, a much more stabilized switching operation can be attained.

While the preferred forms of the present invention have been described, it is to be understood that modifications will be apparent to those skilled in the art without departing from the spirit of the invention.

The scope of the invention, therefore, is to be determined solely by the following claims.

I claim:

1. A single-wired switching circuit directed to use for limiting surge into lamp, comprising:

(a) a diode circuit wherein two sets of diodes are connected in reverse-parallel;

(b) a resistive element connected in series with a lamp to limit the switch-on surge thereinto;

(c) a bidirectionally conductive element having a main current path connected in series with an ac source through said resistive element, diode circuit and lamp; and (d) a timing circuit having a time constant, said timing circuit comprises a rectifier for rectifying the voltage across said diode circuit, a charging circuit with a time constant comprising a resistor and a capacitor, said charging circuit connected in parallel with said diode circuit through said rectifier, a light-emitting diode connected in parallel with said capacitor in such manner that said capacitor discharges into said light-emitting diode after a lapse of the time constant from switch-on, and a photosensitive resistor connected with the gate of said bidirectionally conductive element in such manner that said photosensitive resistor triggers said bidirectionally conductive element when said light-emitting diode emits light.

2. The circuit of claim 1, wherein said resistive element is a resistor.

3. The circuit of claim 1, wherein a thermistor attached to said resistive element is connected in parallel with said photosensitive resistor.

* * * * *